US010688524B2

(12) United States Patent
Fischer et al.

(10) Patent No.: US 10,688,524 B2
(45) Date of Patent: Jun. 23, 2020

(54) METHOD FOR COATING A SUBSTRATE AND COATING DEVICE

(71) Applicant: SUSS MicroTec Lithography GmbH, Garching (DE)

(72) Inventors: Katrin Fischer, Stuttgart (DE); Florian Palitschka, Gauting (DE); Johannes Platen, Kevelaer-Wetten (DE); Kento Kaneko, Munich (DE)

(73) Assignee: SUSS MICROTEC LITHOGRAPHY GMBH, Garching (DE)

( * ) Notice: Subject to any disclaimer, the term of this patent is extended or adjusted under 35 U.S.C. 154(b) by 0 days.

(21) Appl. No.: 14/861,117

(22) Filed: Sep. 22, 2015

(65) Prior Publication Data

US 2016/0089691 A1 Mar. 31, 2016

(30) Foreign Application Priority Data

Sep. 25, 2014 (DE) ..... 10 2014 113 927

(51) Int. Cl.
*B05D 1/02* (2006.01)
*B05D 3/10* (2006.01)

(52) U.S. Cl.
CPC ..... *B05D 1/02* (2013.01); *B05D 3/107* (2013.01)

(58) Field of Classification Search
None
See application file for complete search history.

(56) References Cited

U.S. PATENT DOCUMENTS 5,482,212 A * 1/1996 Kobryn ..... B60S 3/04 239/227
5,734,000 A * 3/1998 Popall ..... C08G 77/06 427/387
5,942,035 A 8/1999 Hasebe et al.
5,952,050 A 9/1999 Doan
6,248,168 B1 6/2001 Takeshita et al.
6,431,466 B1 * 8/2002 Kitajima ..... B05B 7/1209 239/346
6,485,568 B1 11/2002 Thallner
2001/0016230 A1 * 8/2001 Matsuoka ..... B05D 5/066 427/385.5
2001/0033892 A1 * 10/2001 Iizuka ..... B05D 7/574 427/140

(Continued)

FOREIGN PATENT DOCUMENTS

AT 409348 B 7/2002
AT 409462 B 8/2002

(Continued)

OTHER PUBLICATIONS

BMW 650i and 640i Paint Process at BMW Plant, https://www.youtube.com/watch?v=sUgKUbmdOr0, Video Published Sep. 30, 2012, Retrieved on Aug. 7, 2018 (Year: 2012).*

(Continued)

*Primary Examiner* — Francisco W Tschen
(74) *Attorney, Agent, or Firm* — Hayes Soloway PC

(57) ABSTRACT

A method for coating a substrate with a lacquer includes spraying lacquer onto the substrate and subsequently spraying the applied lacquer with solvent. In some embodiments, before the solvent is sprayed the lacquer is heated. Also disclosed is a corresponding coating device for lacquering substrates.

18 Claims, 2 Drawing Sheets

(56) References Cited

U.S. PATENT DOCUMENTS

| | | | | |
|---|---|---|---|---|
| 2002/0007869 | A1* | 1/2002 | Pui | B05B 1/14 141/173 |
| 2002/0078885 | A1* | 6/2002 | Masaki | B05C 5/0216 118/314 |
| 2002/0110640 | A1* | 8/2002 | Tateyama | B05C 11/08 427/240 |
| 2003/0033948 | A1* | 2/2003 | Buono | B41N 10/02 101/395 |
| 2003/0109595 | A1* | 6/2003 | Okada | C08G 18/6254 522/81 |
| 2007/0082499 | A1* | 4/2007 | Jung | G03F 7/162 438/758 |
| 2013/0089668 | A1 | 4/2013 | Inagaki et al. | |
| 2015/0072536 | A1* | 3/2015 | Muramatsu | G03F 7/40 438/781 |
| 2017/0050371 | A1* | 2/2017 | Hemsen | B05C 9/06 |

FOREIGN PATENT DOCUMENTS

| | | | |
|---|---|---|---|
| JP | S5887294 | A | 5/1983 |
| JP | H1097079 | A | 4/1998 |
| JP | 2001102287 | A | 4/2001 |
| JP | 2003236799 | A | 8/2003 |
| JP | 2005334810 | A * | 12/2005 |
| JP | 2005334810 | A | 12/2005 |
| JP | 2009224381 | A | 10/2009 |
| WO | 2005045527 | A2 | 5/2005 |

OTHER PUBLICATIONS

Ji et al. (A metallic buried interconnect process for through-wafer interconnection, J. Micromech. Microeng., 18, 2008, pp. 1-10; Ji) (Year: 2008).*

JP 2009-224381A; citations based on Google Patent Translation Retrieved on Feb, 10, 2020 (Year: 2009).*

Austrian Office Action dated Aug. 12, 2016 (3 pps) with partial translation (1 pp).

German Office Action dated Mar. 16, 2018 (5 pages) with partial translation (2 pages).

SUSS Report, "Developments to Improve Process Stability on the New MA200 GEN3", The Customer Magazine of SUSS Microtec, Issue Jan. 2014, 24 pages.

* cited by examiner

METHOD FOR COATING A SUBSTRATE AND COATING DEVICE

CROSS REFERENCE TO RELATED APPLICATIONS

This application claims the right of priority based on German application serial no. 10 2014 113 927.5, filed Sep. 25, 2014, which is incorporated by reference in its entirety.

BACKGROUND

The disclosure herein relates to a method for coating a substrate with a lacquer and to a coating device for lacquering substrates.

Micro- and nano-fabrication processes typically use lacquers which are applied in a layer onto the substrate to be processed. With the aid of these lacquers it is possible to produce, e.g., masks on the substrates, with the aid of which a desired structure can be produced or processing can be effected on the substrate. For this purpose, the lacquers are, e.g., light-sensitive so that the desired structure can be transmitted from a photo-mask to the light-sensitive lacquer with the aid of optical imaging.

In order to achieve optimum results, it is extremely important that the applied lacquer layer is free of any irregularities and particles. In addition to rotation methods, spraying methods are also used for applying the lacquer onto the substrate, in which spraying methods the lacquer is sprayed onto the substrate by means of a nozzle. Particularly in the case of substrates having topographies, i.e., substrates which themselves already have vertical, three-dimensional structures on their surface, the most homogeneous possible lacquer layer can be achieved in an economical manner only by spraying-on the lacquer.

However, when the lacquer is sprayed on, lacquer particles form on the lacquer layer, as a certain number of lacquer drops dry during the flight between the nozzle and the substrate and then impinge already as (almost) cured lacquer particles upon the surface of the substrate or the lacquer present at this location. These lacquer particles collect on the sprayed-on lacquer layer and lead to problems during further processing, e.g. during exposure to light, and ultimately lead to local defects on the structures produced.

SUMMARY

Disclosed are a method and an apparatus in which a lacquer layer applied on a substrate is even and free of lacquer particles. This is achieved by coating a substrate with a lacquer in which the lacquer is sprayed onto the substrate and the lacquer applied onto the substrate is then sprayed with solvent.

By subsequently spraying the applied lacquer with solvent, the irregularities which have formed on the substrate are levelled out and the lacquer particles which have become attached to the substrate are dissolved so that the surface of the substrate is even and (at least substantially) free of lacquer particles.

The term "lacquer" in this connection is understood to be a mixture of a solvent and a lacquer suitable for the desired application.

Preferably, the solvent is sprayed locally onto the applied lacquer, thus permitting controlled post-treatment of the lacquer.

In one embodiment, between spraying-on the lacquer and spraying the applied lacquer with solvent, the solvent proportion of the applied lacquer is reduced to such an extent that the applied lacquer sets. The term "set" is understood to mean that the viscosity of the applied lacquer is increased such that the applied lacquer no longer flows until further processing. Particularly in the case of substrates having topographies, it is important that the lacquer sets so that edges and slopes of the substrate remain reliably covered with lacquer.

Up to the point of and during spraying with the solvent, the solvent proportion of the applied lacquer must be kept in a range in which, on the one hand, the viscosity of the applied lacquer is sufficiently high to ensure that the lacquer no longer flows. On the other hand, the solvent proportion must not have been reduced such that the lacquer particles or irregularities can no longer be dissolved or levelled out during spraying with solvent.

Preferably, the substrate and/or the applied lacquer is heated during and/or after spraying-on the lacquer, whereby the solvent proportion of the applied lacquer can be reduced in a simple manner.

In one embodiment, the lacquer is sprayed onto the substrate in accordance with a predetermined spraying pattern, preferably in parallel paths, wherein the solvent is likewise sprayed onto the applied lacquer in accordance with the spraying pattern. This ensures that the applied lacquer is sprayed completely with solvent.

Preferably, the duration between the point in time at which the lacquer is sprayed-on at a location on the substrate and the point in time at which this location is sprayed with the solvent is constant, thus ensuring that the applied lacquer always has the same solvent proportion when it is sprayed with the solvent.

In one embodiment, the lacquer is sprayed onto the substrate by means of a lacquer nozzle and the solvent is sprayed by means of a solvent nozzle which is separate from the lacquer nozzle, whereby the substrate can be lacquered quickly and efficiently.

Preferably, the lacquer nozzle and the solvent nozzle are moved above the substrate in parallel with the substrate, in particular at the same time, so that only one drive mechanism is required for the two nozzles.

In accordance with one embodiment, provision is made that, when the lacquer nozzle and the solvent nozzle are moved, the solvent nozzle follows the path of the lacquer nozzle, thus ensuring that the sprayed-on lacquer is then sprayed with solvent.

In one embodiment variation, the lacquer nozzle and the solvent nozzle are moved in at least one plane which is in parallel with the substrate, in parallel paths above the substrate, wherein the distance between the lacquer nozzle and the solvent nozzle is equal to twice or an integer-multiple of the distance between the paths, whereby, on the one hand, a simple spraying pattern is used and, on the other hand, it is ensured that the solvent nozzle takes the same path as the lacquer nozzle.

In one embodiment, if a plurality of lacquer layers are to be applied on the substrate, the applied lacquer is sprayed with solvent after the last lacquer layer is sprayed-on so that irregularities and lacquer particles of the last-applied lacquer layer are levelled out or removed.

When the last lacquer layer is sprayed-on, the lacquer can have a larger solvent proportion than the lacquer of the previously sprayed-on lacquer layer. This ensures that until the sprayed-on lacquer is sprayed with solvent, the solvent proportion of the sprayed-on lacquer is not reduced to such an extent as to no longer allow the removal of lacquer particles and irregularities.

Even if only an individual lacquer layer is sprayed onto the substrate, the solvent proportion of the lacquer used can be selected to be higher than would be the case in conventional spray-coating processes without subsequent spraying with solvent.

In one embodiment, the applied lacquer is sprayed repeatedly with solvent in order to further improve the quality of the surface of the applied lacquer.

The solvent can be acetone or methyl ethyl ketone and therefore known solvents can be used.

The object is also achieved by a coating device for lacquering substrates, in particular substrates having topographies, comprising a substrate holder, a lacquer nozzle, a solvent nozzle and a movement apparatus, on which the lacquer nozzle and the solvent nozzle are arranged at a specific distance with respect to one another, wherein the lacquer nozzle and the solvent nozzle can be moved together by means of a movement apparatus above the substrate holder. By means of the separate solvent nozzle which can be moved together with the lacquer nozzle, it is possible to spray the lacquer, which is applied onto the substrate, with solvent in the same process step and thus to dissolve the lacquer particles which have collected on the applied lacquer and to level out any irregularities produced during spraying.

Preferably, the coating device comprises a heating apparatus, in particular the substrate holder is provided with a heating element, thus making it possible to reduce the solvent proportion of the applied lacquer in a simple manner.

In one embodiment, provision is made that the movement apparatus moves the lacquer nozzle and the solvent nozzle in at least one plane which is in parallel with the substrate holder, in parallel paths above the substrate holder, wherein the distance between the lacquer nozzle and the solvent nozzle is equal to twice or an integer-multiple of the distance between the paths.

The distance between the paths can correspond approximately to the diameter of the lacquer jet which is produced by the lacquer nozzle, on the substrate to be coated, which thus makes it possible for the substrate to be lacquered in a particularly efficient manner as no location on the substrate is left out or sprayed on repeatedly.

During the movement of the lacquer and solvent nozzles in parallel paths, they are then displaced from one another preferably transversely with respect to the longitudinal direction of the paths by the distance between the paths when both the solvent nozzle and the lacquer nozzle or both jets produced by the nozzles have reached the edge of the substrate or have already been moved beyond same.

Adjacent paths are each travelled in opposite movement directions.

BRIEF DESCRIPTION OF THE DRAWINGS

Further features and advantages will be apparent from the following description and the enclosed drawings to which reference is made. In the drawings.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Figure 1:
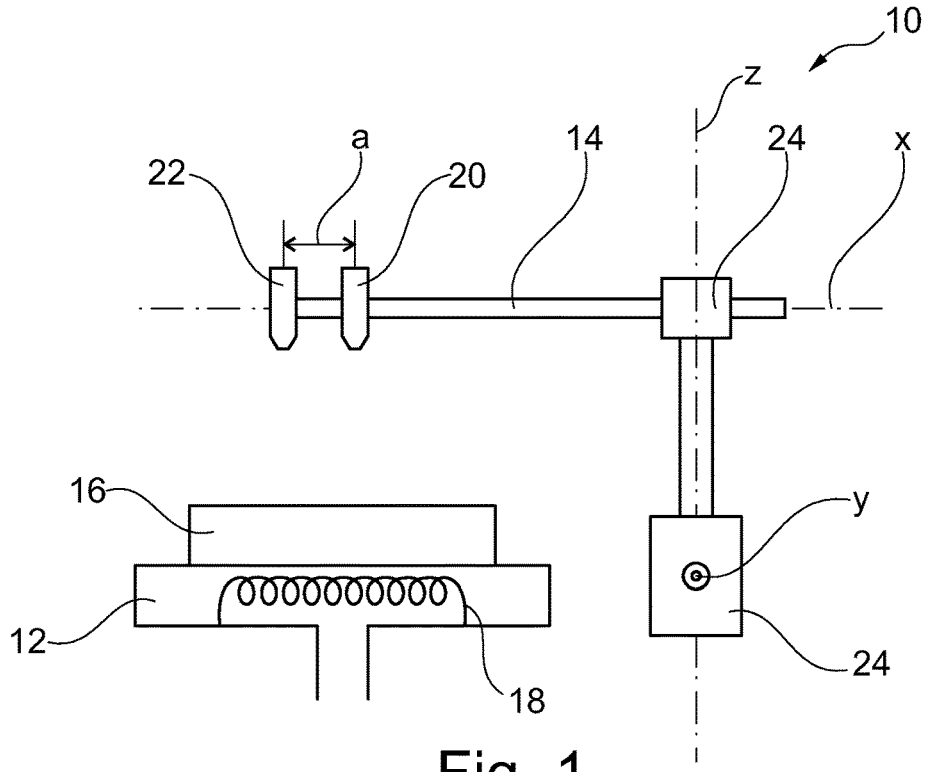
FIG. 1 schematically shows a coating device in a side view.

FIG. 1 schematically illustrates a coating device 10 which is used for coating and treating a substrate. The substrate is, e.g., a semiconductor which is subsequently further processed. The coating device 10 comprises a substrate holder 12 and a movement apparatus 14. On the substrate holder 12, a substrate 16 can be arranged which can be coated with a lacquer with the aid of the coating device 10. The substrate holder 12 is preferably equipped with a heating element 18 which constitutes a heating apparatus for the coating device 10. The heating element can be used to heat the substrate 16 and therefore the lacquer applied on the substrate.

The movement apparatus 14 is provided with two nozzles, namely a lacquer nozzle 20 and a solvent nozzle 22 which are arranged at a specific distance a with respect to one another. The distance "a" relates to the distance between the outlet openings of the lacquer nozzle 20 or the solvent nozzle 22.

The lacquer nozzle 20 and the solvent nozzle 22 are arranged above the substrate 16, i.e. on the side of the substrate 16 facing away from the substrate holder 12. Accordingly, the lacquer nozzle 20 and the solvent nozzle 22 are also provided above the substrate holder 12. The movement apparatus 14 also comprises actuators 24 with the aid of which the lacquer nozzle 20 and the solvent nozzle 22 can be moved.

In the embodiment shown, the lacquer nozzle 20 and the solvent nozzle 22 can be moved with the aid of the movement apparatus 14 along the three axes X, Y, Z which span the space, above the substrate 16 and the substrate holder 12, in particular in a plane spanned by the X-axis and the Y-axis. Where required, provision can additionally be made that the distance between the nozzles and the substrate is changed, i.e. the nozzles are adjusted relative to the substrate in the Z-direction.

In particular, the lacquer nozzle 20 and the solvent nozzle 22 are arranged rigidly on the movement apparatus 14 without the distance "a" between the nozzles 20, 22 changing. However, it is also feasible that the distance "a" is variable whereby the coating device 10 can be used more flexibly.

Figure 3A:
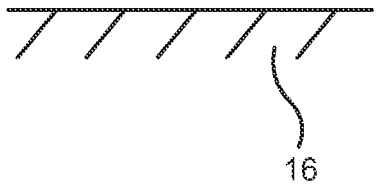
FIG. 3*a* schematically shows a sectional view of a substrate prior to being coated with lacquer in accordance with an embodiment.

In order to coat the substrate 16, lacquer is initially sprayed onto the substrate 16 with the aid of the lacquer nozzle 20. In FIG. 3*a*, the substrate 16 is illustrated partially in section prior to being sprayed with lacquer.

Figure 3B:
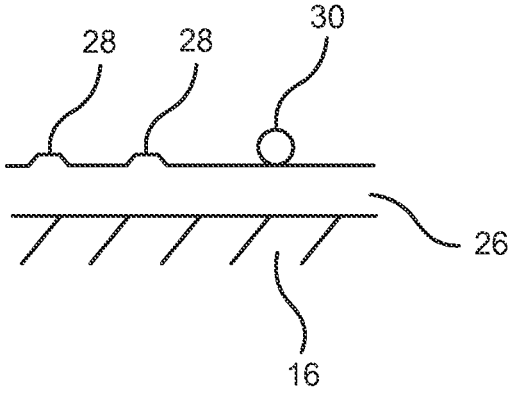
FIG. 3*b* schematically shows a sectional view of a substrate that has been coated with lacquer in accordance with an embodiment.

In FIG. 3*b*, the lacquer nozzle 20 has passed the location shown in FIG. 3*a*, and lacquer is sprayed onto this location on the substrate 16. A lacquer layer 26 is now located on the substrate 16. However, this lacquer layer 26, i.e. the applied lacquer, can have irregularities 28 and lacquer particles 30 which have formed during spraying of the substrate 16.

In order to prevent the lacquer applied onto the substrate 16 from flowing, the substrate 16 and therefore the lacquer layer 26 applied on the substrate 16 can be heated. As a result, the solvent evaporates from the lacquer so that the solvent proportion of the lacquer is reduced and the viscosity of the lacquer increases. This ensures that the applied lacquer sets.

"Set" does not mean that the lacquer is completely dried but rather that its flowability has merely reduced to such an extent that it no longer flows in an undesired manner. Particularly in the case of substrates having vertical topographies which have steep edges and slopes, it is important that the applied lacquer sets as rapidly as possible such that the applied lacquer does not flow off from the edges and higher portions and these locations are left with very little lacquer or without any lacquer.

After the lacquer has been sprayed onto the substrate 16, the solvent nozzle 22 which is separate from the lacquer nozzle 20 passes the location which has just been lacquered, and sprays solvent onto the lacquer layer 26.

The solvent jet produced by the solvent nozzle 22 has a limited diameter so that the lacquer layer 26 is sprayed locally, i.e. at certain locations, with solvent.

The duration between the point in time at which the lacquer is sprayed at one location on the substrate 16 and the point in time at which this location is sprayed with solvent is constant for each location on the substrate 16.

By virtue of the sprayed-on solvent, the lacquer particles 30 present on the lacquer layer 26 are dissolved and connect uniformly to the lacquer layer 26. Moreover, irregularities 28 in the lacquer layer 26 are levelled out.

Figure 3C:
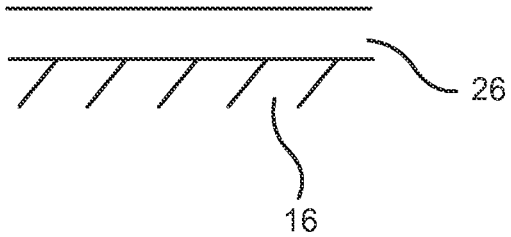
FIG. 3*c* schematically shows a sectional view of a substrate that has been sprayed with solvent in accordance with an embodiment.

This produces an even lacquer layer 26, as illustrated in FIG. 3*c*.

In order to spray the lacquer onto the substrate 16, the lacquer nozzle 20 is moved above the substrate 16. The movement follows a predetermined path and the lacquer nozzle 20 thus travels on a predetermined spraying pattern.

The solvent nozzle 22 is moved at the same time with the lacquer nozzle 20 but is offset by a distance "a". The position of the solvent nozzle 22 with respect to the lacquer nozzle 20, in particular the distance a, is selected to match the spraying pattern such that the solvent nozzle 22 follows the path of the lacquer nozzle 20 and thus travels on the same spraying pattern.

It is sufficient if the path of the solvent nozzle 22 corresponds to the path of the lacquer nozzle 20 only above the substrate 16. Accordingly, the lacquer and the solvent are applied in accordance with the same spraying pattern.

Figure 2:
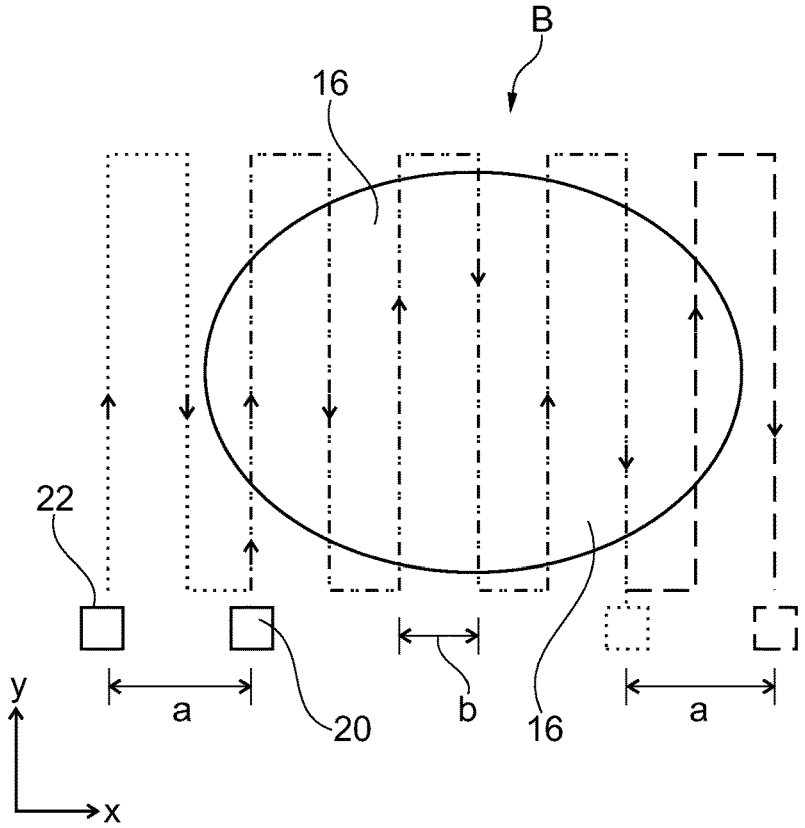
FIG. 2 schematically shows the coating device of FIG. 1 in a plan view.

In order to illustrate a possible spraying pattern, the substrate 16 to be coated, the lacquer nozzle 20 and the solvent nozzle 22 are illustrated in plan view in FIG. 2. For reasons of clarity, the movement apparatus 14 is not illustrated.

The dashed line indicates the path of the lacquer nozzle 20, the dotted line illustrates the path of the solvent nozzle 22. The positions of the lacquer nozzle 20 and the solvent nozzle 22 at the beginning of the coating procedure are indicated as rectangles. The positions of the lacquer nozzle 20 and the solvent nozzle 22 at the end of the coating procedure are indicated by a dashed and dotted rectangle respectively.

The lacquer nozzle 20 and the solvent nozzle 22 are moved by the movement device 14 in parallel paths "B" above the substrate 16 or the substrate holder 12.

The movement is effected in a plane in parallel with the substrate 16 or the substrate holder 12, for example in a plane which is spanned by the X-axis and the Y-axis.

The height of the nozzles 20, 22 along the Z-axis is selected such that the distance "b" between the paths "B" corresponds approximately to the diameter of the lacquer jet which is produced by the lacquer nozzle 20, on the substrate 16 to be coated.

The diameter of the solvent jet produced by the solvent nozzle 22 has preferably the same diameter on the substrate 16 as the lacquer jet.

In the embodiment illustrated in FIG. 2, the distance a between the lacquer nozzle 20 and the solvent nozzle 22 corresponds approximately to twice the distance "b".

Of course, the distance a can also be a different integer-multiple of the distance "b".

The paths "B" are travelled alternately in opposite directions, e.g. in parallel with the Y-axis. Adjacent paths "B" are each travelled in opposite movement directions.

As soon as the lacquer nozzle 20 and also the solvent nozzle 22 or the jets produced by the nozzles 20, 22 have reached the edge of the substrate 16 or have already been moved beyond the edge of the substrate 16, the movement in the Y-direction is stopped, and the two nozzles 20, 22 are offset by the distance "b" between the paths "B" along the X-axis.

Subsequently, the nozzles 20, 22 are moved along the Y-axis in the opposite direction to the preceding movement in the Y-direction until likewise the lacquer nozzle 20 and also the solvent nozzle 22 or the jets produced by the nozzles 20, 22 have reached the edge of the substrate 16 or have been moved beyond same.

The movement of the solvent nozzle 22 is effected, specified by the ratio of the distances "a: and "b", along the same path "B" as the movement of the lacquer nozzle 20 so that the solvent nozzle 22 follows the path of the lacquer nozzle 20.

The coating procedure is terminated as soon as the lacquer nozzle 20 and also the solvent nozzle 22 have completely passed over the substrate 16. This means that the lacquer or solvent jet has passed over the entire surface of the substrate 16.

The lacquer nozzle 20 and the solvent nozzle 22 are now located in their end position as illustrated in FIG. 2 as a dashed and dotted rectangle respectively.

By virtue of the fact that the lacquer nozzle 20 is rigidly coupled to the solvent nozzle 22, in the described embodiment the first two paths "B" of the solvent nozzle 22 extend, at the beginning of the coating procedure, in plan view adjacent to the substrate 16 or the substrate holder 12, whereas the last two paths "B" of the lacquer nozzle 20 extend, at the end of the coating process, in plan view adjacent to the substrate 16 or the substrate holder 12.

While the lacquer nozzle 20 and the solvent nozzle 22 are moved over the substrate, lacquer is sprayed from the lacquer nozzle 20 and solvent is sprayed from the solvent nozzle 22.

The lacquer can be a mixture of solvent and pure lacquer, e.g. a photoresist, and so the term "lacquer" is understood to mean a lacquer-solvent mixture.

The solvent used can be acetone or methyl ketone. However, other solvents or mixtures of solvents which can dissolve the lacquer used are also feasible.

Preferably, the lacquer nozzle 20 and the solvent nozzle 22 are oriented in such a manner that the jets produced thereby do not overlap on the substrate. On the contrary, the jets can adjoin one another.

Moreover, while the lacquer nozzle 20 and the solvent nozzle 22 are moved above the substrate 16 or the substrate holder 12, the substrate holder 12 is heated by the heating element 18. In this manner, the substrate 16 and the lacquer layer already sprayed thereon are heated.

The illustrated coating procedure and in particular the demonstrated spraying pattern are to be understood as being by way of example only. For example, it is also possible that the solvent nozzle 22 directly follows the lacquer nozzle 20. In this case, the carrier on which they are arranged must be rotated at the end of each path by 180° so that the solvent nozzle 22 is then located "behind" the lacquer nozzle in the subsequent path.

It is also feasible for the applied lacquer to be sprayed repeatedly with solvent in order to further reduce the number of lacquer particles 30 and irregularities 28 on the lacquer layer 26.

Likewise, provision can be made that the lacquer and the solvent are sprayed from the same nozzle. In this case, the nozzle travels over the substrate repeatedly, wherein the lacquer is sprayed in one pass and the solvent is sprayed in another pass.

Of course, it is also possible to apply a plurality of lacquer layers on the substrate. In this case, the applied lacquer is sprayed with solvent after the last lacquer layer has been sprayed-on. The solvent proportion of the lacquer for spraying-on the last lacquer layer can be selected to be larger than the solvent proportion of the previously used lacquer.

In general, even if only one layer of lacquer is sprayed-on, the solvent proportion of the lacquer can be selected to be larger than would be the case in a comparable spraying process without subsequent spraying with solvent.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the disclosure. This description should be read to include one or at least one and the singular also includes the plural unless it is obvious that it is meant otherwise.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Persons skilled in the relevant art can appreciate that many modifications and variations are possible in light of the above disclosure. Accordingly, the disclosure of the embodiments of the invention is intended to be illustrative, but not limiting, of the scope of the invention, which is set forth in the following claims.

What is claimed is:

1. A method for coating a substrate with a lacquer in a micro- and/or nano-fabrication process, comprising the steps of:

spraying the lacquer onto the substrate using a first moveable nozzle;

using a second moveable nozzle separate from and distally spaced from the first moveable nozzle, subsequently spraying the lacquer applied to the substrate with a material consisting essentially of solvent that at least partially dissolves the lacquer, wherein the lacquer and the material consisting essentially of solvent are different materials, and wherein in spraying the material consisting essentially of solvent, the second moveable nozzle follows a movement path of the first moveable nozzle in tandem; and heating the lacquer, which has been sprayed onto the substrate, prior to said subsequently spraying.

2. The method of claim 1, wherein the material consisting essentially of solvent is sprayed locally onto the applied lacquer.

3. The method of claim 1, wherein spraying the lacquer onto the substrate further is performed in accordance with a predetermined spraying pattern; and subsequently spraying the lacquer applied to the substrate with the material consisting essentially of solvent is performed in accordance with the predetermined spraying pattern.

4. The method of claim 1, wherein a duration between a first point in time at which the lacquer is sprayed at each location on the substrate and a second point in time at which such location is sprayed with the material consisting essentially of solvent is constant.

5. The method of claim 1, further comprising repeating said spraying of the lacquer onto the substrate prior to said subsequently spraying the lacquer applied to the substrate with the material consisting essentially of solvent.

6. The method of claim 5, wherein the lacquer during said repeated spraying has a larger solvent proportion than the lacquer during initial said spraying of the lacquer onto the substrate.

7. The method of claim 1, further comprising repeating said subsequently spraying the lacquer applied to the substrate with the material consisting essentially of solvent.

8. The method of claim 1, wherein the solvent is acetone or methyl ketone.

9. The method of claim 1, wherein the first moveable nozzle and the second moveable nozzle are arranged in a spatially fixed relationship relative to one another such that prior to the spraying of the material consisting essentially of solvent, the applied lacquer is allowed to set on the substrate, in that a solvent proportion of the applied lacquer is reduced such that a viscosity of the applied lacquer increases such that the applied lacquer no longer flows until further processing yet the material consisting essentially of solvent is still permitted to reduce at least one of lacquer particles on the applied lacquer and irregularities in the applied lacquer.

10. The method of claim 9, wherein the first moveable nozzle and the second moveable nozzle are arranged rigidly such that movement along an axis perpendicular to a plane of the substrate is substantially prevented.

11. The method of claim 9, further comprising heating the substrate in a manner that facilitates setting of the applied lacquer on the substrate.

12. The method of claim 1, wherein the material consisting essentially of solvent is lacquer-free.

13. A method for coating a substrate with a lacquer in a micro- and/or nano-fabrication process, comprising the steps of:

spraying the lacquer onto the substrate using a first moveable nozzle; and using a second moveable nozzle separate from and distally spaced from the first moveable nozzle, subsequently spraying the lacquer applied to the substrate with a material consisting essentially of solvent that at least partially dissolves the lacquer, wherein the lacquer and the material consisting essentially of solvent are different materials, and wherein in spraying the material consisting essentially of solvent, the second moveable nozzle follows a movement path of the first moveable nozzle in tandem;

heating the lacquer, which has been sprayed onto the substrate, prior to said subsequently spraying; and moving the first moveable nozzle and the second moveable nozzle in tandem at the same time above the substrate and in parallel with the substrate in effectuating the spraying of the lacquer and the spraying of the material consisting essentially of solvent, wherein the spraying of the lacquer and the spraying of the material consisting essentially of solvent occur concurrently during at least a portion of the moving.

14. The method of claim 13, wherein moving the first moveable nozzle and the second moveable nozzle comprises moving the first moveable nozzle and the second moveable nozzle in at least one plane parallel with the substrate, in parallel paths above the substrate, wherein a first distance between the first moveable nozzle and the second moveable nozzle is equal to an integer-multiple of a second distance between the parallel paths.

15. The method of claim 13, wherein the material consisting essentially of solvent is lacquer-free.

16. The method of claim 13, wherein the movement path oscillates over the substrate.

17. The method of claim 13, wherein the second moveable nozzle follows the movement path of the first moveable nozzle with an offset.

18. A method for coating a substrate with a lacquer in a micro- and/or nanofabrication process, comprising the steps of:

spraying the lacquer onto the substrate using a first moveable nozzle; and using a second moveable nozzle separate from and distally spaced from the first moveable nozzle, subsequently spraying the lacquer applied to the substrate with a material consisting essentially of solvent that at least partially dissolves the lacquer, wherein the lacquer and the material consisting essentially of solvent are different materials, and wherein in spraying the material consisting essentially of solvent, the second moveable nozzle follows a movement path of the first moveable nozzle in tandem; and moving the first moveable nozzle and the second moveable nozzle in tandem at the same time above the substrate and in parallel with the substrate in effectuating the spraying of the lacquer and the spraying of the material consisting essentially of solvent, wherein the spraying of the lacquer and the spraying of the material consisting essentially of solvent occur concurrently during at least a portion of the moving;

wherein the first moveable nozzle and the second moveable nozzle are arranged in a spatially fixed relationship relative to one another such that prior to the spraying of the material consisting essentially of solvent, the applied lacquer is allowed to set on the substrate, in that a solvent proportion of the applied lacquer is reduced such that a viscosity of the applied lacquer increases such that the applied lacquer no longer flows until further processing yet the material consisting essentially of solvent still reduces at least one of lacquer particles on the applied lacquer and irregularities in the applied lacquer.

* * * * *